US010875042B1

(12) United States Patent
Junkel et al.

(10) Patent No.: US 10,875,042 B1
(45) Date of Patent: Dec. 29, 2020

(54) BOTTLE CLOSURE

(71) Applicant: O2COOL, LLC, Chicago, IL (US)

(72) Inventors: Eric F. Junkel, Mount Prospect, IL (US); Tom Zeng, Shenzhen (CN); Oliver Breit, Sheung Wan (HK); Lars Junker, Tai Kok Tsui (HK); Vicky Hui, Tsing Yi (HK); Michael Ksiazek, Burr Ridge, IL (US)

(73) Assignee: O2COOL, LLC, Chicago, IL (US)

( * ) Notice: Subject to any disclaimer, the term of this patent is extended or adjusted under 35 U.S.C. 154(b) by 0 days.

(21) Appl. No.: 16/576,969

(22) Filed: Sep. 20, 2019

(51) Int. Cl.
*B05B 11/00* (2006.01)

(52) U.S. Cl.
CPC ..... *B05B 11/3052* (2013.01); *B05B 11/0037* (2013.01)

(58) Field of Classification Search
CPC ..... B05B 11/3052; B05B 11/0037; B05B 11/3057
See application file for complete search history.

(56) References Cited

U.S. PATENT DOCUMENTS 3,913,844 A 10/1975 Petrovic
4,095,725 A 6/1978 Goncalves
4,373,644 A 2/1983 Bennett
4,441,633 A 4/1984 Bennett
4,506,805 A 3/1985 Marcon
4,618,076 A * 10/1986 Silvenis ..... B05B 11/0037 222/331
4,805,812 A 2/1989 Brody
4,867,347 A 9/1989 Wass et al.
4,932,563 A 6/1990 Diamond et al.
5,016,781 A * 5/1991 Ten Wolde ..... A61L 9/14 222/162
5,169,032 A 12/1992 Steijns et al.
5,228,600 A 7/1993 Steijns et al.
5,238,152 A 8/1993 Maas et al.
5,297,701 A 3/1994 Steijns et al.
5,542,581 A * 8/1996 Habora ..... B05B 11/0037 222/331

(Continued)

FOREIGN PATENT DOCUMENTS

EM 04539518-0002 12/2017
EM 004594836-0001 1/2018
WO 2013/171906 A1 11/2013

*Primary Examiner* — David P Angwin
*Assistant Examiner* — Bob Zadeh
(74) *Attorney, Agent, or Firm* — Thompson Cobum LLP

(57) ABSTRACT

A bottle closure includes a drink spout, a pump mechanism, and a trigger mechanism. The pump mechanism includes a plunger configured to be movable along a first axis to pump a liquid, and the plunger is operatively connected to a first camming surface. The trigger mechanism is connected to the pump mechanism and movable linearly along a second axis. The second axis is transverse with the first axis. The trigger mechanism is configured to actuate the pump mechanism to pump the liquid as the trigger mechanism is moved. The trigger mechanism has a second camming surface configured to engage with the first camming surface of the pump mechanism. The first and second camming surfaces are shaped and configured such that motion of the trigger mechanism causes the second camming surface to engage with the first camming surface to move the plunger along the first axis.

20 Claims, 8 Drawing Sheets

(56) References Cited

U.S. PATENT DOCUMENTS

D385,792 S 11/1997 Sayers et al.
5,711,461 A * 1/1998 Foster ..... B05B 11/0064 222/383.1
5,715,974 A * 2/1998 Foster ..... B05B 11/3011 222/383.1
5,722,569 A * 3/1998 Foster ..... B05B 11/3011 222/153.13
5,788,125 A * 8/1998 Steiner ..... B05B 11/0037 222/331
5,823,395 A * 10/1998 Foster ..... B05B 11/3011 222/153.02
5,947,341 A * 9/1999 Montaner ..... B05B 11/3011 222/340
D417,590 S 12/1999 Kato
6,003,738 A 12/1999 Foster et al.
6,010,034 A 1/2000 Walthers
6,119,888 A 9/2000 Goto et al.
6,217,294 B1 4/2001 Amieri et al.
6,244,469 B1 6/2001 Knickerbocker
D451,023 S 11/2001 Kitamura et al.
D492,158 S 6/2004 Bodum
6,983,864 B1 1/2006 Cagle
D530,609 S 10/2006 Beaver et al.
7,143,958 B1 12/2006 Dorney
D538,110 S 3/2007 Kitamura et al.
7,210,602 B2 5/2007 Blanchester
D547,184 S 7/2007 Kim et al.
D582,779 S 12/2008 Bourne
D586,183 S 2/2009 Junkel
D589,743 S 4/2009 Pearson
7,712,618 B2 5/2010 Barre et al.
7,735,689 B2 6/2010 Alluigi
D629,644 S 12/2010 Zhuang et al.
D655,581 S 3/2012 Kotani
8,230,888 B2 7/2012 Crossdale et al.
D675,060 S 1/2013 Lane
D686,040 S 7/2013 Lane
D686,871 S 7/2013 Lane
8,544,691 B2 10/2013 Roosel et al.
D698,249 S 1/2014 Nicolas
D698,657 S 2/2014 Bernstein et al.
8,657,160 B2 2/2014 Lashells et al.
D700,515 S 3/2014 Herbst
D702,505 S 4/2014 Nakatani
8,684,235 B2 4/2014 Inaba et al.
D718,626 S 12/2014 Lane
D727,106 S 4/2015 Lai
9,028,457 B2 * 5/2015 Leach ..... A61M 1/02 604/290
D741,637 S 10/2015 Palermo et al.
D744,290 S 12/2015 Endo
D744,846 S 12/2015 Koop et al.
D747,918 S 1/2016 Herbst et al.
D758,800 S 6/2016 Hayslett et al.
D767,338 S 9/2016 Jones
D772,652 S 11/2016 Yao
D773,255 S 12/2016 Horimoto
D784,763 S 4/2017 Oshana
D786,072 S 5/2017 Breit et al.
D789,150 S 6/2017 Heiberger
D794,453 S 8/2017 Boroski et al.
D795,011 S 8/2017 Pisarevsky
D801,111 S 10/2017 Eyal
D807,110 S 1/2018 Lown
D828,718 S 9/2018 Ksiazek et al.
D829,054 S 9/2018 Breit et al.
D830,118 S 10/2018 Ksiazek et al.
10,518,282 B2 * 12/2019 Ksiazek ..... B65D 47/243
2002/0053577 A1 * 5/2002 Maas ..... B05B 11/0037 222/383.1
2004/0056049 A1 * 3/2004 Stradella ..... B05B 11/0032 222/321.7
2005/0035154 A1 2/2005 Meshberg
2006/0113327 A1 6/2006 Walters et al.
2006/0113329 A1 6/2006 Walters et al.
2007/0228190 A1 10/2007 Tanner
2008/0006718 A1 * 1/2008 Junkel ..... A45F 3/16 239/333
2009/0032618 A1 * 2/2009 Hornsby ..... B05B 15/33 239/333
2009/0184177 A1 7/2009 Wu et al.
2009/0314811 A1 12/2009 Dennis
2011/0036871 A1 * 2/2011 Tada ..... B05B 11/3011 222/383.1
2011/0284541 A1 11/2011 Webster et al.
2013/0001323 A1 1/2013 Bodet et al.
2014/0138410 A1 * 5/2014 Marbet ..... B05B 11/3011 222/383.2
2014/0346257 A1 11/2014 Reetz, III et al.
2016/0214125 A1 7/2016 Hextall
2016/0228899 A1 8/2016 Gonzalez et al.
2016/0355305 A1 12/2016 Hoskins
2017/0157632 A1 6/2017 Alluigi
2018/0290164 A1 10/2018 Ksiazek et al.
2019/0083996 A1 3/2019 Sakata

* cited by examiner

BOTTLE CLOSURE

BACKGROUND

The present disclosure pertains to a bottle closure having a body and a cover with a push button type of trigger.

SUMMARY

One aspect of the present disclosure is a bottle closure for releasable attachment to a bottle and for providing hydration to a user. The bottle closure includes a drink spout, a pump mechanism, and a trigger mechanism. The drink spout is adapted and configured to be in fluid communication with a bottle to enable a user to extract a liquid. The pump mechanism is configured to be in fluid communication with a bottle to enable a liquid to be pumped and discharged through a nozzle. The pump mechanism includes a plunger configured to be movable along a first axis to pump a liquid, and the plunger is operatively connected to a first camming surface. The trigger mechanism is operatively connected to the pump mechanism and movable linearly along a second axis between a first trigger position and a second trigger position. The second axis is not parallel with the first axis. The trigger mechanism is configured to actuate the pump mechanism to pump the liquid as the trigger mechanism is moved between the first trigger position and the second trigger position. The trigger mechanism has a second camming surface configured to engage with the first camming surface of the pump mechanism. The first and second camming surfaces are shaped and configured such that motion of the trigger mechanism along the second axis between the first and second trigger positions causes the second camming surface to engage with the first camming surface to move the plunger along the first axis.

Another aspect of the present disclosure is a bottle closure for releasable attachment to a bottle and for providing hydration to a user. The bottle closure includes a first discharge aperture for dispensing a liquid, a body, a pump mechanism, a trigger mechanism, and a second discharge aperture separated from the first discharge aperture. The pump mechanism is supported by the body and includes a variable volume fluid receiving cavity and a plunger reciprocally movable along a first axis and within the fluid receiving cavity between a first plunger position in which the fluid receiving cavity has a first volume and a second plunger position in which the fluid receiving cavity has a second volume smaller than the first volume. The plunger is configured to change the volume of the fluid receiving cavity as the pump mechanism moves between the first plunger position and the second plunger position. The pump mechanism includes a first check valve in a first intake liquid flow path configured for permitting fluid flow to the fluid receiving cavity from the first intake liquid flow path and for checking fluid flow from the pump mechanism to the first intake liquid flow path. The pump mechanism further includes a second check valve in a first discharge liquid flow path configured for permitting fluid flow from the fluid receiving cavity to the first discharge liquid flow path and for checking fluid flow from the first discharge liquid flow path to the fluid receiving cavity. The first discharge liquid flow path terminates at the first discharge aperture. The plunger is operatively connected to a first camming surface such that the plunger is drivable. The trigger mechanism is operatively connected to the pump mechanism and movable linearly along a second axis between a first trigger position and a second trigger position. The second axis is not parallel with the first axis. The trigger mechanism is configured to actuate the pump mechanism to pump the liquid as the trigger mechanism is moved between the first trigger position and the second trigger position. The trigger mechanism has a second camming surface configured to engage with the first camming surface of the pump mechanism. The first and second camming surfaces are shaped and configured such that motion of the trigger mechanism along the second axis between the first and second trigger positions causes the second camming surface to engage with the first camming surface to move the plunger along the first axis. The second discharge aperture is in fluid communication with a second intake liquid flow path.

Further features and advantages, as well as the structure and operation of various embodiments disclosed herein, are described in detail below with reference to the accompanying drawings.

BRIEF DESCRIPTION OF THE DRAWINGS

The accompanying drawings, which are incorporated in and form a part of the specification, illustrate the embodiments of the present disclosure and together with the description, serve to explain the principles of the disclosure. In the drawings.

DETAILED DESCRIPTION

Figure 1:
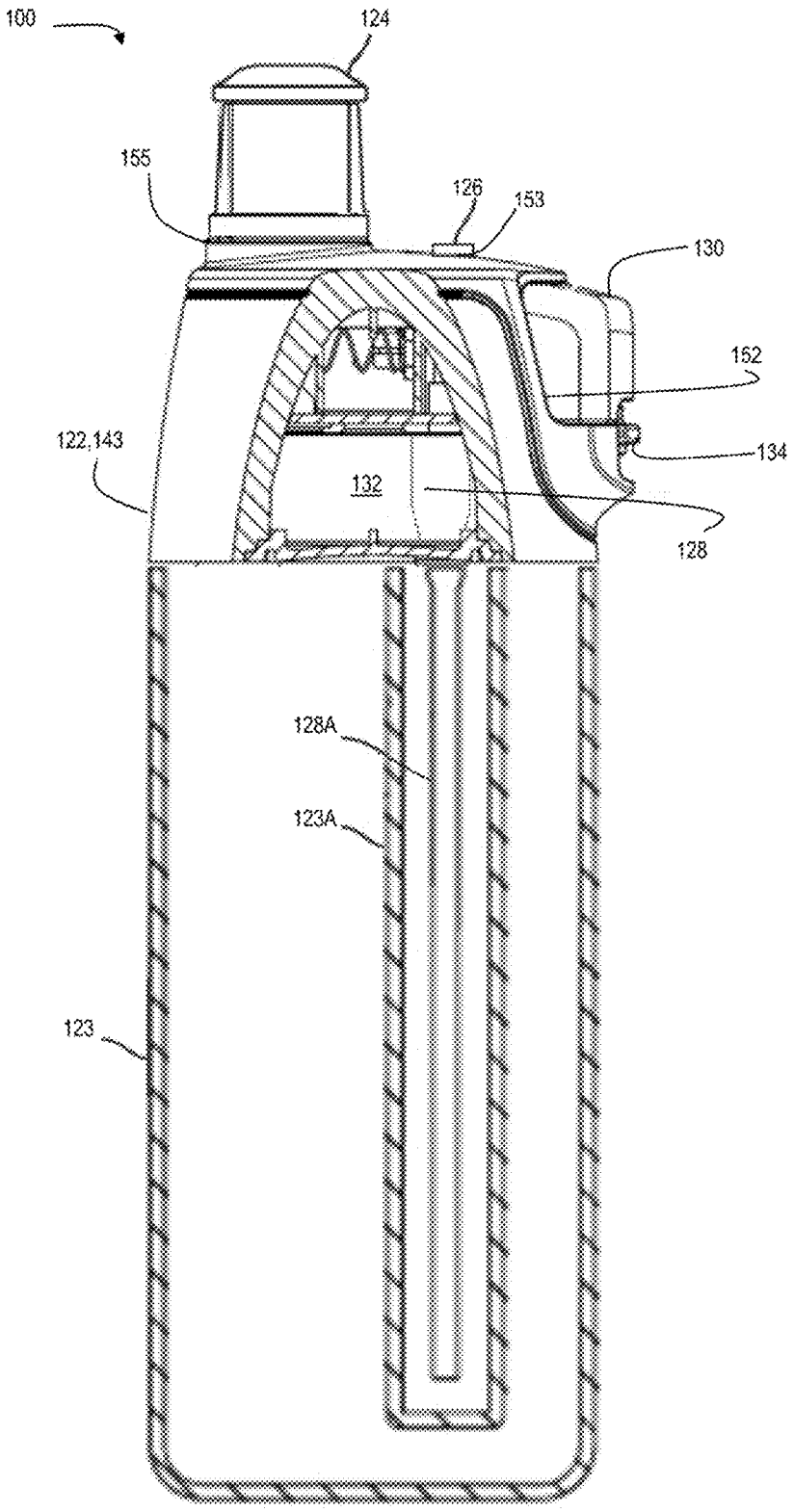
FIG. 1 is a partial cross-sectional view of an exemplary bottle closure positioned on a bottle to form a container.
Figure 2:
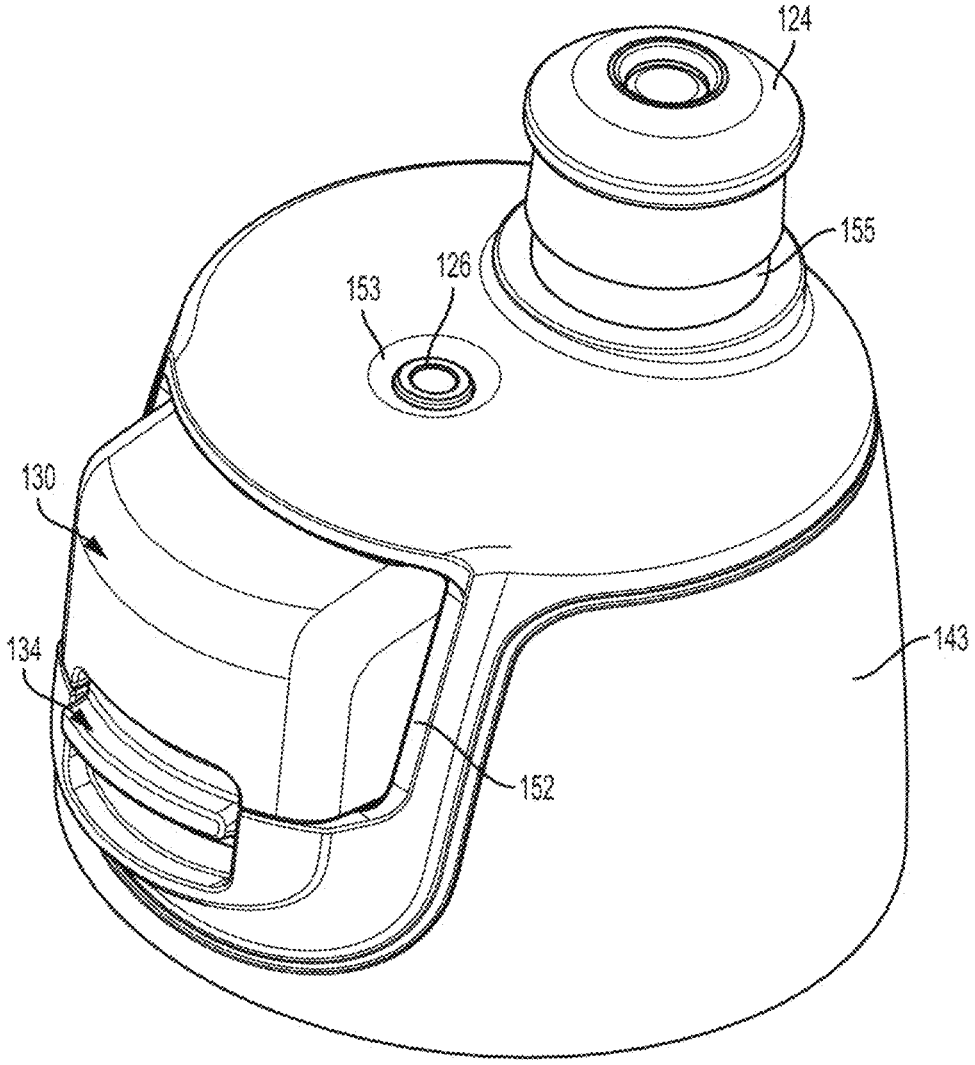
FIG. 2 is a top perspective view of an exemplary bottle closure.
Figure 3:
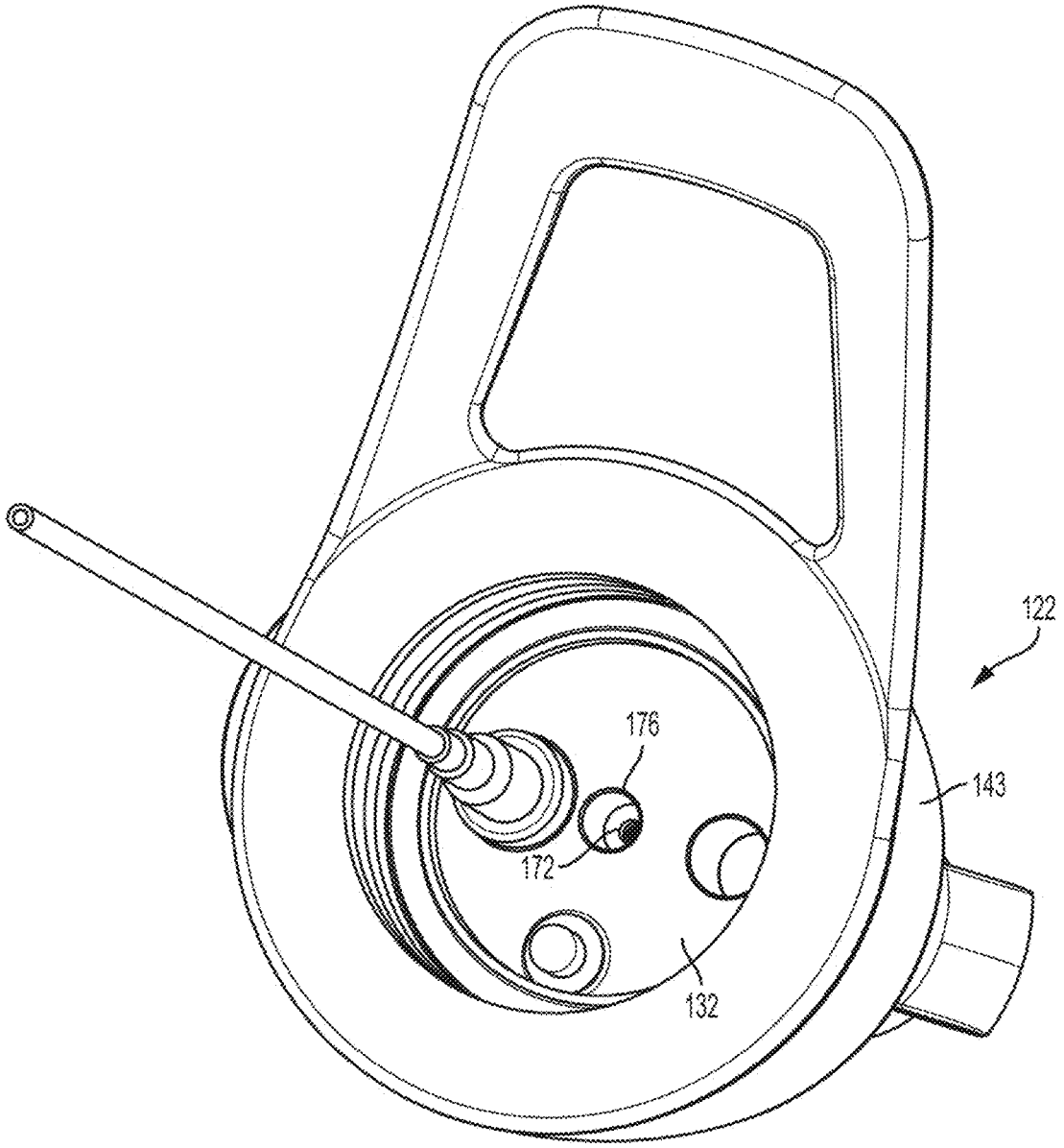
FIG. 3 is a bottom perspective view of the bottle closure of FIG. 2.

FIGS. 1-8 show an exemplary container 100 for providing hydration. The exemplary container 100 is configured to dispense a liquid either through a drink spout for drinking or a nozzle for providing a mist. The container 100 includes a bottle closure 122 and a bottle 123. The bottle closure 122 may be releasably securable to the bottle 123 in forming the container 100. The bottle closure 122 includes a drink spout 124 and a nozzle 126 both of which are adapted and configured for dispensing a liquid contained in the bottle 123. The drink spout 124 is adapted and configured for dispensing a liquid, for instance, for drinking. A user can open drink spout 124 to allow the user to extract the liquid from the interior of the bottle, and close the drink spout 124 to seal the liquid in the interior of the bottle. The nozzle 126 is adapted and configured for dispensing a liquid, for instance, via a mist. The nozzle 26 may be also adapted and configured to dispense liquid in alternative patterns, for example, a stream. The drink spout 124 may be in communication with the interior of the bottle 123 so that the user may draw liquid from the interior of the bottle through the drink spout for drinking, for instance, by squeezing the bottle or by drawing a vacuum at the drink nozzle. To assist in providing a mist via the nozzle 126, a pump mechanism 128 and trigger mechanism may be provided.

The pump mechanism 128 and the trigger mechanism 130 are supported on a body 132 of the bottle closure 122. The pump mechanism 128 has a discharge aligned with the nozzle 126 to enable a liquid to be pumped from the interior of the bottle and discharged through nozzle. The pump mechanism 128 may be driven by a trigger mechanism 130. The trigger mechanism 130 is adapted and configured to actuate the pump mechanism 128 to pump a liquid as the trigger mechanism 130 is moved between a first trigger position and a second trigger position. The pump and trigger mechanism will be discussed in greater detail below.

The bottle closure 22 may also include a cover 143. The cover 143 of the bottle closure 122 extends at least in part around the body 132, and at least partially covers the pump mechanism 128, and the trigger mechanism 130. With the cover installed 143 on the body 132 to form the bottle closure 122, the cover preferably provides protection for the trigger mechanism 130 and the pump mechanism 128. With the cover 143 removed, the body 132 including the pump mechanism 128 and the trigger mechanism 130 may be exposed as desired for cleaning. Further, with the cover 143 removed, a user may clean the cover 143 and its interior surfaces. The cover 143 may be releasably coupled to the body 132, as will be discussed below. In the alternative, the cover may be permanently attached to the body (e.g., sonically welded together, adhered, or the like).

The bottle closure cover 143 may also include a window 152. The window 152 may be configured to accommodate at least a portion of the trigger mechanism 130. The window 152 allows the trigger mechanism 130 to extend through the window 152 and provides access for the user to manipulate the trigger mechanism 130 to drive the pump mechanism 128 to spray a liquid through the nozzle 126. The trigger mechanism 130 is configured to be actuated by a user and may have a shape that is ergonomic for a fit with a user's finger.

The cover 143 further includes a nozzle opening 153 configured to accommodate the nozzle 126 such that the nozzle can spray a liquid that exits the bottle closure 122. The cover 143, the nozzle opening 153, and the nozzle 126 are configured such that the nozzle 126 does not extend past an outer surface of the cover 143. For example, and without limitation, the first opening 153 may be frustoconical and extend downward from the cover 143. The nozzle 126 may be configured such that, as the pump mechanism 128 is actuated, the nozzle 126 moves within the frustoconical first opening 153. During such movement, the distal end of the nozzle 126 opposite the pump mechanism 128 may be configured to not extend outward past the cover 143 and to extend inward below the frustoconical opening 153, such that the nozzle reciprocates (e.g. vertically in the drawing) within the opening 153.

The cover 143 may further include a drink spout opening 155 configured to accommodate the drink spout 124 such that liquid is dischargeable from the bottle closure 122 through the drink spout 124. A portion of the drink spout 124 is positioned within the drink spout opening 155 such that the drink spout is able to engage and disengage with a passageway to permit and prevent liquid from flowing out of the bottle closure 122 through the drink spout 124.

As best shown in FIG. 1, the bottle 123 may include a secondary bottle 123A. The drink spout 124 may be in fluid communication with the interior of the main bottle 123 such that a user can extract a liquid within the bottle through the drink spout 124. In the embodiment depicted, the bottle closure 122 is releasably securable to a secondary bottle 123A disposed within the interior of the main bottle 123. A dip tube 128A extends within the secondary bottle 123A and is coupled to the pumping mechanism 128 that draws a liquid from the secondary bottle 123A through the dip tube 128A and expels the fluid through the nozzle 126 when the pumping mechanism is driven by the trigger mechanism 130. The secondary bottle 123A may be releasably coupled to the bottle closure 122 such that the secondary bottle is suspended within the main bottle 123. In alternative embodiments, the secondary bottle is secured to, shares a wall with, and/or is formed as part of the bottle 123. A first liquid may be contained within the main bottle 123, and a second liquid may be contained within the secondary bottle 123A. Thus, the secondary bottle 123A allows the bottle closure 122 to dispense a liquid different from the liquid contained in the main bottle 123. For example, and without limitation, the main bottle 123 may contain a liquid such as a sports drink that a user may extract using the drink spout 124 for consumption, and the secondary bottle 123A may contain a liquid such as water that a user may use to mist himself or herself through actuation of the pump mechanism using the trigger mechanism. In an alternative embodiment, the secondary bottle may be omitted and the dip tube 128A may be configured to extend into and/or fluid communication with the main bottle 123. In such a configuration, the same liquid may be dispensed from both the drink spout 124 and the nozzle 126. The bottle closure 122 may be configured as desired so that it is capable of being coupled to the secondary bottle 123A but is optionally not coupled to the secondary bottle thereby allowing the secondary bottle to be removably attached to the bottle closure and used as desired by the user. Alternatively, the bottle closure 122 may be configured such that it is only able to be coupled to the bottle 123 and may not be coupled to the secondary bottle.

Figure 7:
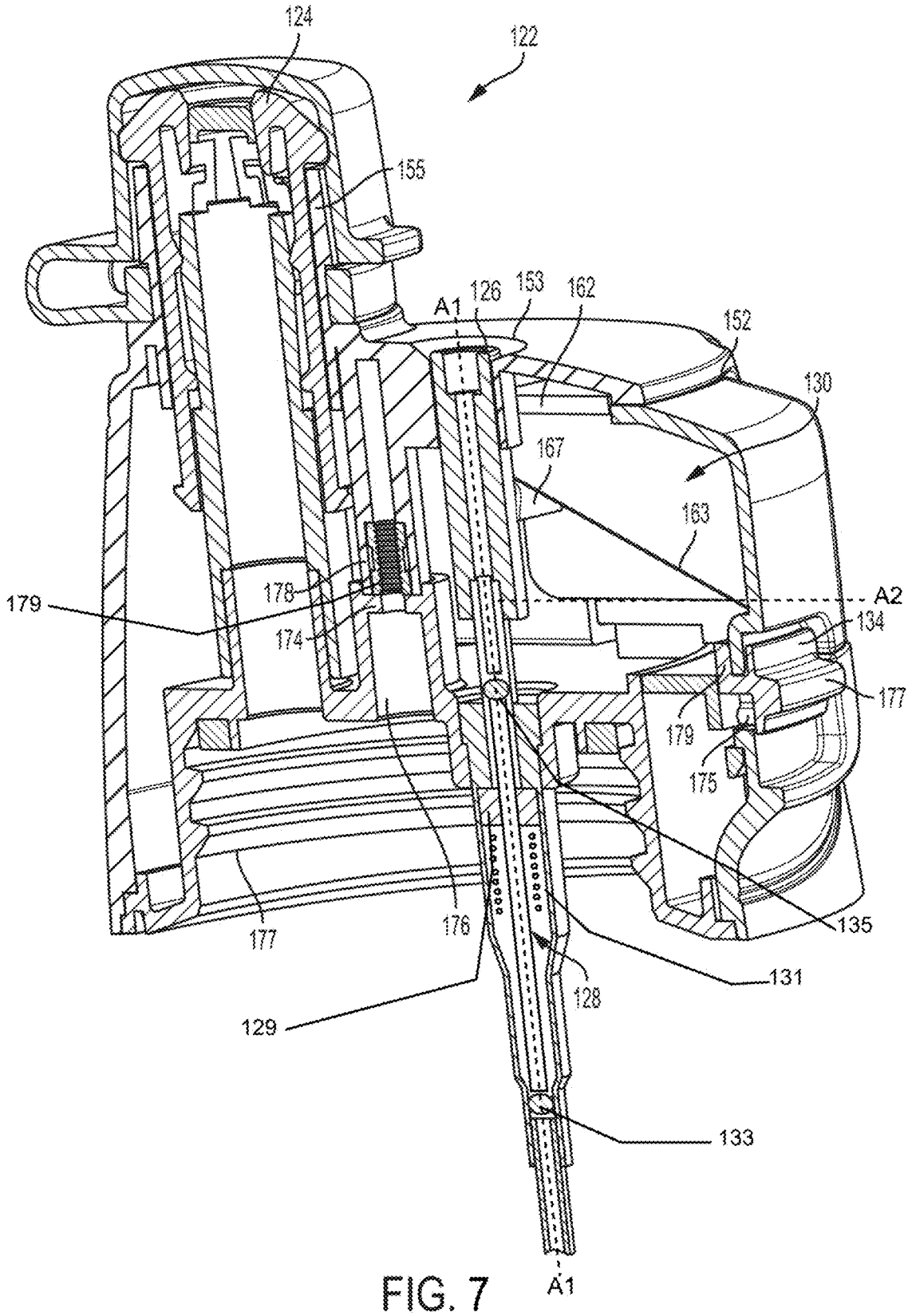
FIG. 7 is a cross-sectional, perspective view of the bottle closure of FIG. 2 with a trigger mechanism in a first trigger position.
Figure 8:
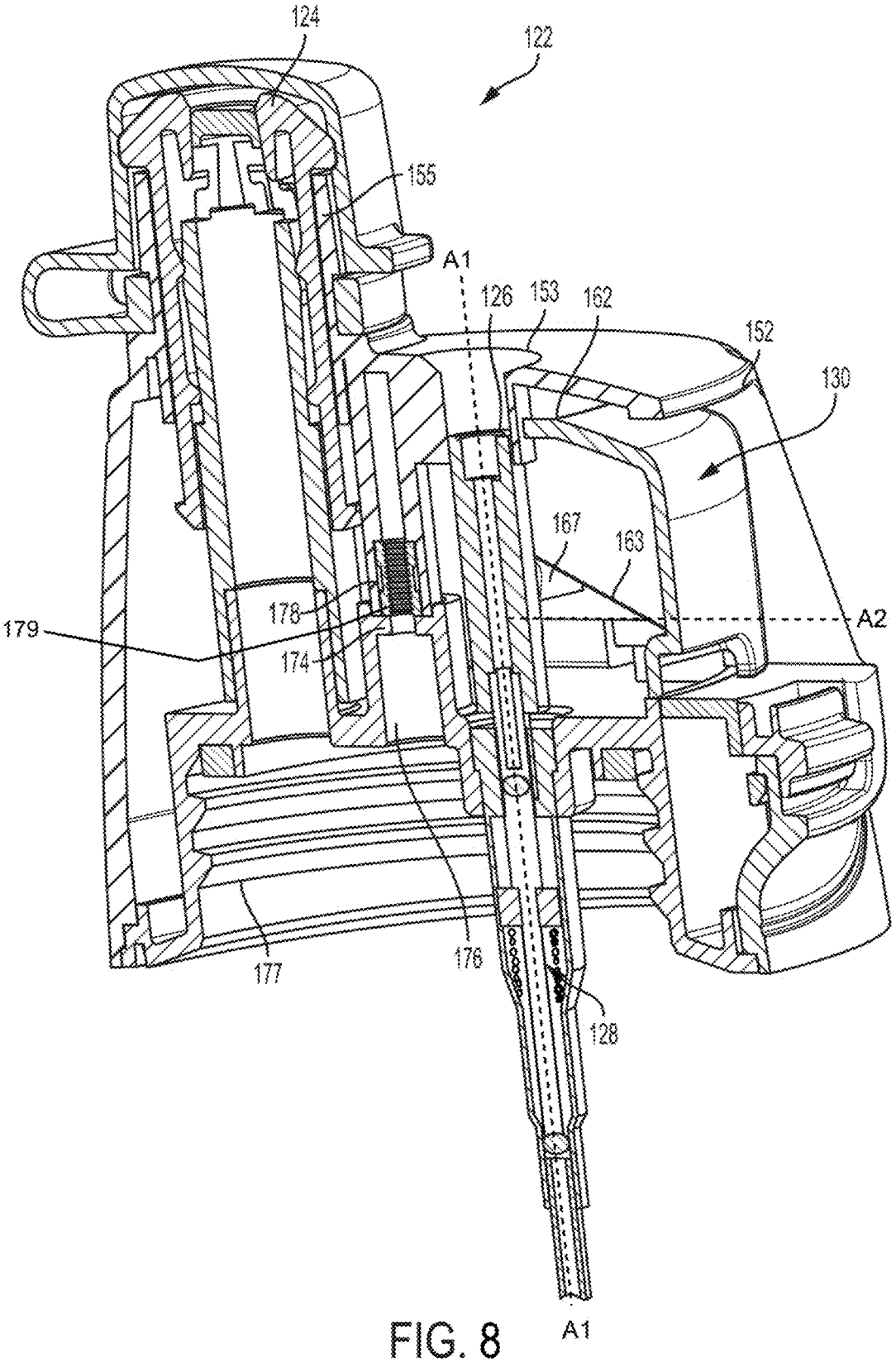
FIG. 8 is a cross-sectional, perspective view of the bottle closure of FIG. 2 with the trigger mechanism in a second trigger position.

As best shown in FIGS. 7 and 8, the pump mechanism 128 has a spring loaded plunger 129 configured to reciprocate along a first axis A1 within a cylinder 131 to pump a liquid. The plunger 129 moves along the first axis A1 between a first plunger position within the cylinder 131 to establish a first volume and a second plunger position within the cylinder to establish a second volume smaller than the first volume. The pump mechanism 128 further includes an inlet check valve 133 at the inlet to the cylinder and an outlet check valve 135 at an outlet of the cylinder. The inlet check valve 133 may be configured for permitting fluid flow to the fluid receiving cavity 131 from the first intake liquid flow path and for checking fluid flow from the pump mechanism 128 to the first intake liquid flow path. The second check valve 135 is in a first discharge liquid flow path configured for permitting fluid flow from the fluid receiving cavity 131 to the first discharge liquid flow path to the nozzle 126 and for checking fluid flow from the first discharge liquid flow path to the fluid receiving cavity 131.

The trigger mechanism 130 is operatively connected to the pump mechanism 128 and is movable linearly about a second axis A2 between a first trigger position and a second trigger position. The trigger mechanism 130 of bottle closure 122 actuates the pump mechanism 128 to spray liquid through the nozzle 126. The trigger mechanism 130 moves laterally/horizontally between the first and second trigger positions along the axis A2. The trigger mechanism 130 includes a trigger portion 161, a body portion 162, a cam 163, and at least one biasing member 165*a*,165*b*.

The second axis A2 and movement of the trigger mechanism between the first and second positions is substantially perpendicular to the first axis A1 and the centerline of the bottle closure (e.g., the second axis is within zero to five degrees of perpendicular to the first axis). For example, and without limitation, the trigger mechanism 130 moves horizontally within the window 152 of the cover 143. The body portion 162 and the window 152 are sized such that the trigger mechanism 130 is guided along the horizontal second axis A2 and remains secured within the cover 143 as it travels between the first trigger position and the second trigger position. For example, and without limitation, a portion of the body 162 of the trigger mechanism 130 disposed within the cover may be larger than the window 152 to prevent the trigger mechanism 130 from the exiting cover 143.

The cam 163 of the trigger mechanism 130 is configured to engage with a cam following surface 167 of the pump mechanism. As the cam 163 moves with the trigger mechanism 130 between the first and second positions, the profile of the cam 163 causes the cam follower 167 to move vertically about the first axis. The cam 163 and the cam following surface 167 function together to transform motion of the trigger mechanism 130 about the second axis into motion of the plunger about the first axis. In the depicted embodiment, the cam surface 163 is an included plane having a constant slope so that the cam surface 163 has a linear cam profile whereby the lateral motion of the trigger mechanism 130 along the second axis is converted to vertical motion in the pump mechanism 128 in the first axis with a linear relationship. In alternative embodiments, the cam surface 163 has a non-linear cam profile. The cam following surface 167 is, for example and without limitation, a cylindrical (e.g., right circular cylinder, oval cross sectioned cylinder, or the like) protrusion from a body of the pump mechanism 128 or other suitable structure and operatively connected, either integrally or monolithically with the plunger 129. The plunger 129 is operatively connected to the cam following surface 167. Force applied to the cam following surface 167 causes the plunger to move towards the second plunger position. A spring causes the plunger to return to the first plunger position.

The spring 165 of the trigger mechanism 130 biases the trigger mechanism 130 toward the first trigger position. In the depicted embodiment, the trigger mechanism 130 includes a first spring 165*a* and a second spring 165*b*. The first spring 165*a* and the second spring 165*b* are positioned on opposite sides of the pump mechanism 128 such that the springs, the trigger mechanism 130 and pump mechanism 128 are contained within the cover 143. The body portion 162 of the trigger mechanism 130 may have a geometry that accommodates the pump mechanism 128. The body portion 162 may have a central cutout 169 defining between two arms 171. The cutout 169 is sized such that the pump mechanism 128 is receivable within the cutout 169 as the trigger mechanism 130 is moved toward the second trigger position. The two arms 171 of the body portion 162 pass on either side of the pump mechanism 128 as the trigger mechanism 130 is moved toward the second trigger position. The cam surface 163 may be provided on one or both of the arms adjacent to the cut-out.

The bottle closure 122 further includes a lock mechanism 134 engageable with the trigger mechanism 130 to lock and unlock the trigger mechanism 130 to prevent and permit movement of the trigger mechanism 130 between the first and second trigger position. When the lock mechanism 134 is in an engaged position, the trigger mechanism 130 is prevented from moving between the first trigger position and the second trigger position. When the lock mechanism 134 is in a disengaged position, the trigger mechanism 130 is permitted to move between the first trigger position and the second trigger position.

The lock mechanism 134 includes a guide portion 173, detents 175, a lever 177, and a latching portion 179. The guide portion 173 is positioned within a corresponding slot in the cover 143 such that the lock mechanism 134 is guided vertically between the engaged and disengaged positions. One or more detents 175 are positioned on the guide portion 173 and engage with the slot to maintain the lock mechanism 134 in the engaged and disengaged positions until a user overcomes the force of the detent 175 to move the lock mechanism 134. The lock mechanism 134 is movable by a user through the lever 177. The lever 177 extends laterally to provide a surface for user interaction. The latching portion 179 engages and disengages with the trigger mechanism 130 to prevent or permit movement of the trigger mechanism 130 between the first trigger position and the second trigger position. In the depicted embodiment, the latching portion 179 forms a channel that is capable of receiving a corresponding portion (e.g., a flange) of the trigger mechanism 130. When the trigger mechanism is in the first trigger position and the locking mechanism 134 is in the engaged position, the latching portion 179 receives the trigger mechanism 130 such that lateral motion of the trigger mechanism is prevented. When the lock mechanism 134 is moved to the disengaged position, the flange of the trigger mechanism 130 is removed from the channel of the latching portion 179 such that the trigger mechanism 130 is permitted to move laterally between the first trigger position and the second trigger position.

The closure 122 may include a threaded fastener 172 that removably couples the cover 143 to the body 132. The body 132 of the closure 122 may include a bore 174 sized to accommodate the shaft of the fastener 172 and a counter bore 176 sized to accommodate the head of the fastener. The closure 122 may further include an o-ring, gasket, or a like seal positioned within the counterbore. The shaft of the fastener 172 may pass through the o-ring and the head of the fastener 172 may engage with the body of the o-ring such that the o-ring forms a seal between the body 132 and the fastener 172 to prevent liquid from passing through the bore 174. In alternative embodiments, the closure 122 need not include a counterbore 176. The cover 143 includes a threaded receiver 178 that corresponds to the location of the bore 174 in the body 132. The threaded receiver 178 is threaded such that the threaded shaft of the fastener 172 engages with the threaded receiver to securely and removably couple the body 132 to the cover 143. A socket 179 may be formed on a shoulder on an opposite face of the counter bore 176 in the body 132. The threaded receiver 178 may be adapted and configured to fit within the socket 179, and positively align threaded receiver with the bore 174. For example, and without limitation, the threaded receiver 178 may be cylindrical and extend downward from the cover 143 such that, when the cover 143 is engaged with the body 132, the threaded receiver is received in the socket 179. In some embodiments, the threaded receiver 178 is at least partially metallic. For example, and without limitation, the threaded receiver 178 includes a metallic insert being threaded to accommodate the fastener 172. The metallic insert may be formed in a plastic cover 143 (e.g., during an injection molding process), may be inserted into the threaded receiver 178 after the cover 143 is formed and secured (e.g., using adhesive), or otherwise coupled to the cover 143. The metallic threads of the threaded receiver 178 increase the lifespan of the threaded receiver in comparison to plastic threads formed in the threaded receiver 178. In use, a user may unscrew the closure 122 from a bottle 136 (e.g., using the threads 177 in the body 132). Doing so provides access to the fastener 172. The user may unscrew the fastener 172 from the threaded receiver 178. With the fastener 172 unscrewed from the threaded fastener 178, the user may separate the cover 143 from the body 132. With the body 132 and the cover 143 separated, the user may clean the closure 122. The user may reassemble the closure 122 by placing the cover 143 on the body 132, inserting the fastener 172 into the bore and counter bore 174,176, and screwing the fastener 172 into the threaded receiver 178.

Figure 4:
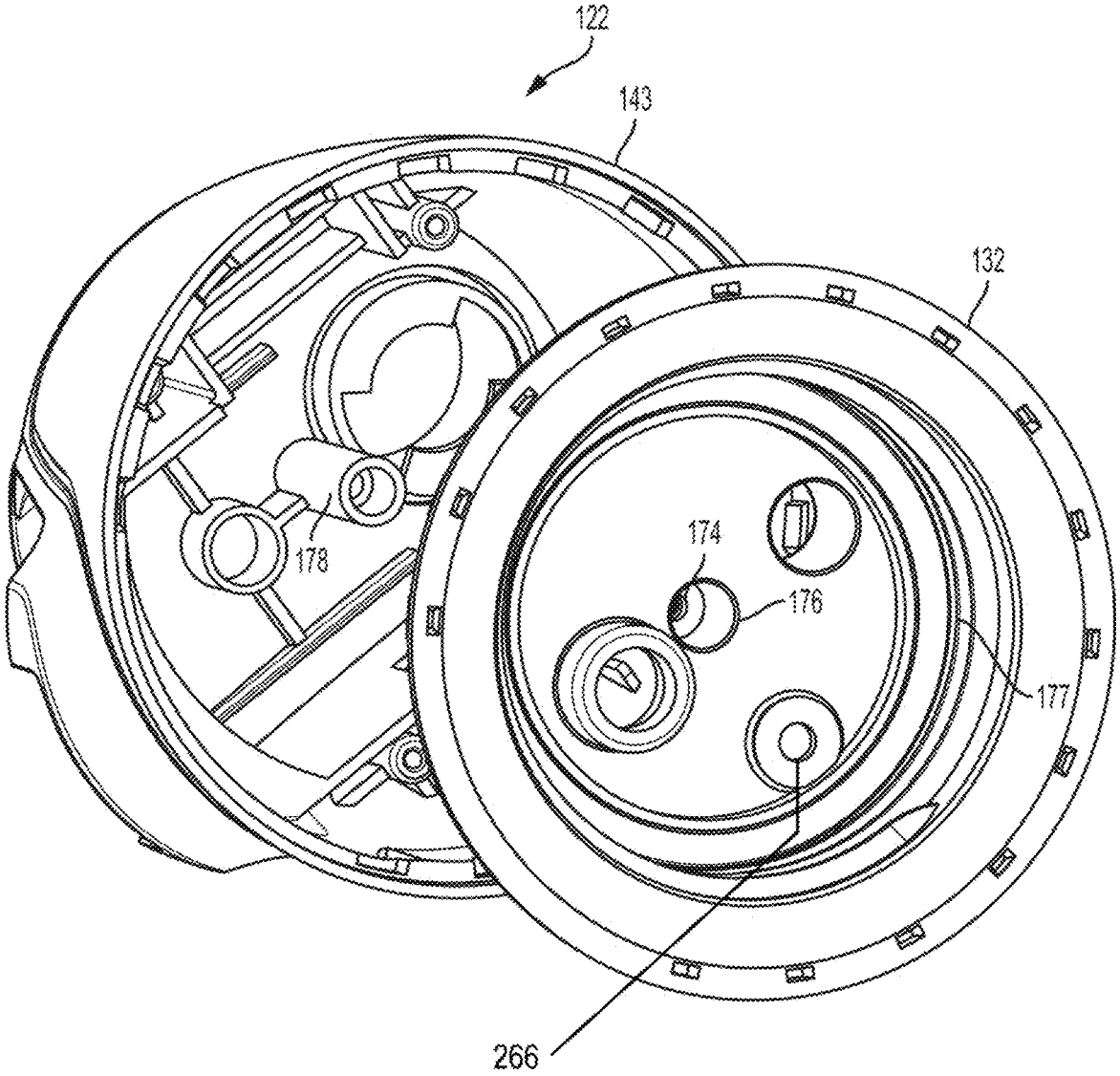
FIG. 4 is an exploded view of the bottle closure of FIG. 2 showing a cover and a body of the bottle closure.
Figure 5:
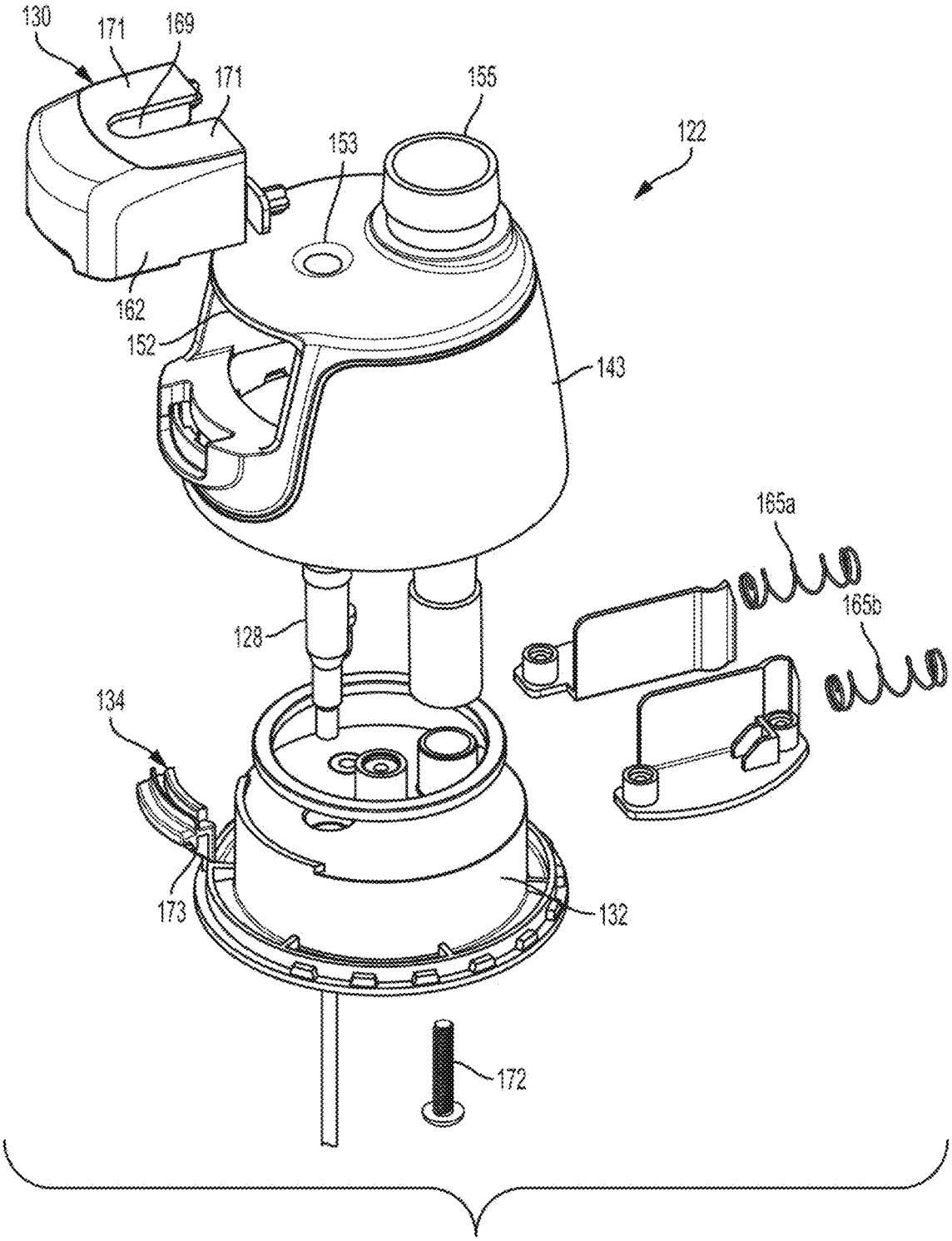
FIG. 5 is an additional exploded view of the bottle closure of FIG. 2.
Figure 6:
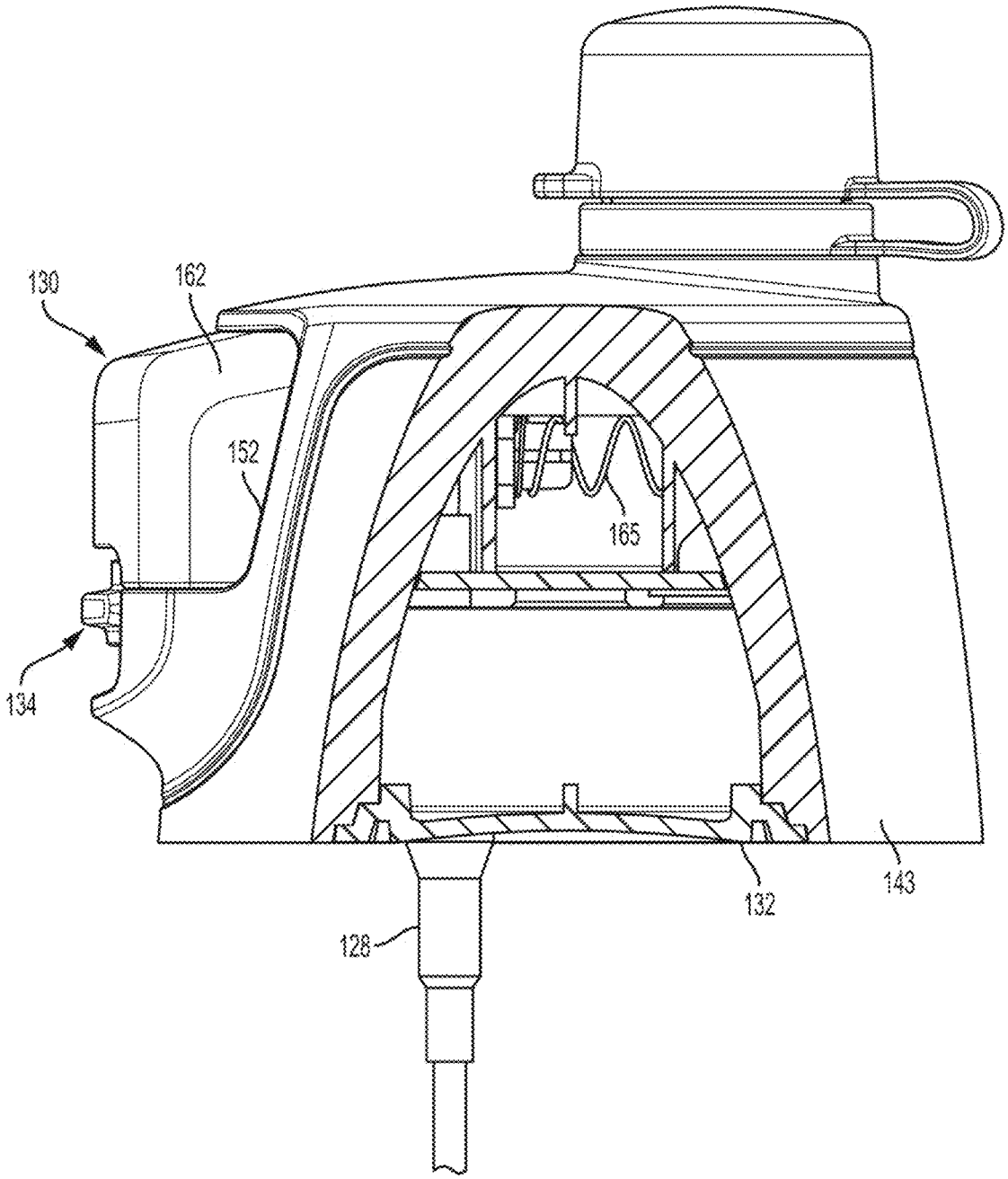
FIG. 6 is a side elevation view of the bottle closure of FIG. 2 with a portion removed to show additional detail of the bottle closure.

The body 32 may include a vent 266 (FIG. 4). The vent extends through the body 132 and provides fluid communication between the bottle 123 and the atmosphere to facilitate the flow of a liquid out of the bottle through the closure 122. While the drawings show a closure with a vent, the closure need not include a vent, for example, a squeeze type bottle (e.g., a bottle adapted and configured to reduce in volume as a liquid is dispensed).

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies.

What is claimed is:

1. A bottle closure for releasable attachment to a bottle and for providing hydration to a user, the bottle closure comprising:

a drink spout adapted and configured to be in fluid communication with the bottle to enable the user to extract a liquid;

a pump mechanism configured to be in fluid communication with the bottle to enable the liquid to be pumped and discharged through a nozzle, the pump mechanism having a plunger configured to be movable along a first axis to pump the liquid, the plunger being operatively connected to a first camming surface; and a trigger mechanism operatively connected to the pump mechanism and movable linearly along a second axis between a first trigger position and a second trigger position, the second axis being transverse to the first axis, the trigger mechanism configured to actuate the pump mechanism to pump the liquid as the trigger mechanism is moved between the first trigger position and the second trigger position, the trigger mechanism having a second camming surface configured to engage with the first camming surface of the pump mechanism, the first and second camming surfaces being shaped such that motion of the trigger mechanism along the second axis between the first and second trigger positions causes the second camming surface to engage with the first camming surface to move the plunger along the first axis.

2. A bottle closure in accordance with claim 1 wherein the second camming surface is an inclined plane having a constant slope.

3. A bottle closure in accordance with claim 1 wherein the second axis is within zero to five degrees of perpendicular to the first axis.

4. A bottle closure in accordance with claim 1 further comprising a spring configured to bias the trigger mechanism toward the first trigger position.

5. A bottle closure in accordance with claim 1 further comprising a first spring and a second spring configured to bias the trigger mechanism toward the first trigger position.

6. A bottle closure in accordance with claim 5, wherein the first spring and the second spring are positioned on opposite sides of the pump mechanism.

7. A bottle closure in accordance with claim 5, wherein the trigger mechanism has a body portion with a cutout defining two spaced apart arms, each arm being positionable on opposite sides of the pump mechanism such that the pump mechanism is receivable within the cutout when the trigger mechanism moves between the first trigger position and the second trigger position.

8. A bottle closure in accordance with claim 1 further comprising a lock mechanism engageable with the trigger mechanism and movable between an engaged position and a disengaged position, the lock mechanism being configured to engage the trigger mechanism when the lock mechanism is in the engaged position and thereby prevent the trigger mechanism from moving between the first trigger position and the second trigger position, the lock mechanism being configured to permit the trigger mechanism to move between the first trigger position and the second trigger position when the lock mechanism is in the disengaged position.

9. A bottle closure in accordance with claim 8 wherein the lock mechanism is movable in a direction parallel to the first axis between the engaged position and the disengaged position.

10. A bottle closure in accordance with claim 1 wherein the bottle closure includes a body supporting the pump mechanism and a cover at least partially covering the body, the cover is removeably connected to the body with a fastener.

11. A bottle closure for releasable attachment to a bottle and for providing hydration to a user, the bottle closure comprising:

a body;

a cover with first and second discharge apertures for dispensing a liquid, the cover at least partially covering the body;

a pump mechanism supported by the body comprising a variable volume fluid receiving cavity and a plunger reciprocally movable along a first axis and within the fluid receiving cavity between a first plunger position in which the fluid receiving cavity has a first volume and a second plunger position in which the fluid receiving cavity has a second volume smaller than the first volume, the plunger configured to change the volume of the fluid receiving cavity as the pump mechanism moves between the first plunger position and the second plunger position, the pump mechanism including a first check valve in a first intake liquid flow path configured for permitting fluid flow to the fluid receiving cavity from the first intake liquid flow path and for checking fluid flow from the pump mechanism to the first intake liquid flow path, the pump mechanism including a second check valve in a first discharge liquid flow path configured for permitting fluid flow from the fluid receiving cavity to the first discharge liquid flow path and for checking fluid flow from the first discharge liquid flow path to the fluid receiving cavity, the first discharge liquid flow path terminating at the first discharge aperture, the plunger being operatively connected to a first camming surface such that the plunger is movable between the first and second plunger positions via the first camming surface;

a trigger mechanism operatively connected to the pump mechanism and movable linearly along a second axis between a first trigger position and a second trigger position, the second axis being transverse to the first axis, the trigger mechanism being configured to actuate the pump mechanism to pump the liquid as the trigger mechanism is moved between the first trigger position and the second trigger position, the trigger mechanism having a second camming surface configured to engage with the first camming surface of the pump mechanism, the first and second camming surfaces being shaped such that linear motion of the trigger mechanism along the second axis between the first and second trigger positions causes the second camming surface to engage with the first camming surface to move the plunger along the first axis between the first and second plunger positions;

wherein the second discharge aperture is separated from the first discharge aperture, and the second discharge aperture is in fluid communication with a second intake liquid flow path.

12. A bottle closure in accordance with claim 11 wherein the first discharge aperture is in fluid communication with a nozzle configured to discharge the liquid as a mist, and wherein the second discharge aperture is in fluid communication with a drink spout.

13. A bottle closure in accordance with claim 11 wherein the second camming surface is an inclined plane having a constant slope.

14. A bottle closure in accordance with claim 11 wherein the second axis is within zero to five degrees of perpendicular to the first axis.

15. A bottle closure in accordance with claim 11 further comprising a first spring and a second spring configured to bias the trigger mechanism toward the first trigger position.

16. A bottle closure in accordance with claim 15, wherein the first spring and the second spring are positioned on opposite sides of the pump mechanism.

17. A bottle closure in accordance with claim 15, wherein the trigger mechanism has a body portion, the body portion has a cutout defining two spaced apart arms, each arm is positionable on opposite sides of the pump mechanism such that the pump mechanism is receivable within the cutout when the trigger mechanism moves between the first trigger position and the second trigger position.

18. A bottle closure in accordance with claim 11 further comprising a lock mechanism engageable with the trigger mechanism and movable between an engaged position and a disengaged position, the lock mechanism being configured to engage the trigger mechanism when the lock mechanism is in the engaged position and thereby prevent the trigger mechanism from moving between the first trigger position and the second trigger position, the lock mechanism being configured to permit the trigger mechanism to move between the first trigger position and the second trigger position when the lock mechanism is in the disengaged position.

19. A bottle closure in accordance with claim 18 wherein the lock mechanism moves in a direction parallel to the first axis within a guide of the cover between the engaged position and the disengaged position.

20. A bottle closure in accordance with claim 11 wherein the cover is removeably connected to the body with a fastener.

* * * * *